US007060662B2

(12) United States Patent
Muchmore et al.

(10) Patent No.: US 7,060,662 B2
(45) Date of Patent: Jun. 13, 2006

(54) ANTIFOAM AGENT AND METHOD FOR USE IN AUTOMATIC TRANSMISSION FLUID APPLICATIONS INVOLVING HIGH PRESSURE PUMPS

(75) Inventors: Robert A. Muchmore, Dexter, MI (US); Reuben Sarkar, Novi, MI (US); Anthony J. Rollin, Midlothian, VA (US); Samuel H. Tersigni, Richmond, VA (US); Marc Deweerdt, Machelen (BE); Stede Granger, Flowery Branch, GA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 10/365,582

(22) Filed: Feb. 12, 2003

(65) Prior Publication Data

US 2005/0054542 A1 Mar. 10, 2005

Related U.S. Application Data

(60) Provisional application No. 60/356,981, filed on Feb. 14, 2002.

(51) Int. Cl.
*C10M 139/00* (2006.01)
*C10M 161/00* (2006.01)

(52) U.S. Cl. ..... 508/206; 508/208; 508/210; 508/273; 508/433; 508/469; 252/78.3

(58) Field of Classification Search ..... 252/78.3; 508/206–210
See application file for complete search history.

(56) References Cited

U.S. PATENT DOCUMENTS

| | | | | |
|---|---|---|---|---|
| 2,375,007 | A * | 5/1945 | Larsen et al. | 508/202 |
| 4,059,534 | A * | 11/1977 | Morro et al. | 508/208 |
| 4,136,043 | A | 1/1979 | Davis | |
| 4,140,643 | A | 2/1979 | Davis | |
| 4,301,019 | A | 11/1981 | Horodysky et al. | |
| 4,411,806 | A * | 10/1983 | Tirtiaux et al. | 508/208 |
| 4,612,129 | A | 9/1986 | DiBiase et al. | |
| 4,990,273 | A | 2/1991 | Croudace | |
| 5,372,735 | A | 12/1994 | Ohtani et al. | |
| 5,422,023 | A | 6/1995 | Francisco | |
| 5,766,513 | A | 6/1998 | Pillon et al. | |
| 6,090,758 | A * | 7/2000 | Pillon et al. | 508/208 |
| 6,221,815 | B1 * | 4/2001 | Grabowski et al. | 508/208 |
| 6,251,840 | B1 | 6/2001 | Ward, Jr. et al. | |
| 6,828,286 | B1 * | 12/2004 | Komiya et al. | 508/192 |

FOREIGN PATENT DOCUMENTS

| | | |
|---|---|---|
| EP | 0 601 266 B1 | 6/1996 |
| EP | 0 630 960 B1 | 8/1999 |
| EP | 0 761 805 B1 | 3/2001 |

* cited by examiner

*Primary Examiner*—Ellen McAvoy
(74) *Attorney, Agent, or Firm*—Leah Oubre Robinson; Dennis H. Rainear

(57) ABSTRACT

The present invention relates to the use of a high level of a silicon-containing antifoam agent in automatic transmission fluid ("ATF") applications. More specifically, the invention relates to a formulation and method for the reduction or elimination of pump whine that occurs in high-pressure pumps used to circulate transmissions fluids in vehicles. The invention also relates to fully formulated ATFs, to transmissions lubricated with such ATFs, and to vehicles containing transmissions lubricated with such ATFs.

26 Claims, No Drawings

ANTIFOAM AGENT AND METHOD FOR USE IN AUTOMATIC TRANSMISSION FLUID APPLICATIONS INVOLVING HIGH PRESSURE PUMPS

This application claims priority from U.S. Provisional Application No. 60/356,981 filed Feb. 14, 2002.

TECHNICAL FIELD

The present invention relates to automatic transmission fluids (ATFs) for use in automatic transmissions and more specifically to the use of antifoam agents in ATFs and/or in ATF additive systems. By "automatic transmissions" herein is meant both continuously variable transmissions, known as CVT, and conventional automatic transmissions.

BACKGROUND OF THE INVENTION

It is common knowledge that air, be it entrained or surface foam, will cause pressure ripples in hydraulic pumps, due to implosion of air bubbles. These pressure ripples can manifest themselves as objectionable audible noise, manifest as "pump whine" in some transmissions. New automatic transmissions with their compact sumps and high pump pressures have raised the possibility of consumer reaction to this issue. A number of OEMs have taken steps to reduce the air level in the fluid in their new transmissions by (1) isolating, or "baffling", the internal rotating components to separate them from the fluid, or (2) introducing "aeration" additives into the ATF to help the oil release the entrained air more quickly or reduce the level of entrained air. Additionally, traditional ATF additive technology would include at low levels a common "antifoam" agent to help dissipate surface air bubbles.

Antifoams work in part by being insoluble in ATF. This lack of solubility, though necessary for foam reduction, can have a negative impact on the amount of antifoam that can be added to an ATF to form a stable mixture. Conventional ATFs can contain 3–10 ppm silicon contribution from the antifoam agent. For most ATF applications, this level is suitable for controlling foam. However, in modern transmissions with high pressure pumps, this level may not be adequate due to loss of antifoam activity. Conventional wisdom holds to the notion that higher levels of antifoam actually degrade air release performance by impeding entrained bubbles from releasing from the fluid. The effect of increased aeration due to high levels of antifoam is thought to be exacerbated in high pressure hydraulic applications.

U.S. Pat. No. 6,251,840 describes lubricating compositions for ATFs with decreased air entrainment. The European counterpart EP 0761805 B1 teaches a mixture of silicone and fluorosilicone antifoam agents.

U.S. Pat. No. 5,766,513 describes antifoam agents in ATFs having a polyacrylate and fluorosilicone, wherein the antifoam agents are used in very low, traditional amounts.

U.S. Pat. No. 5,372,735 describes an effective way of overcoming the shudder problem associated with the continuous slip torque converter clutches for use in automatic transmissions, especially shudder which occurs with new friction materials before break-in.

U.S. Pat. No. 5,422,023 describes lubricant compositions containing alkyl substituted dimercaptothiodiazoles together with an alpha-olefin/malic ester copolymer in a lubricating oil.

U.S. Pat. No. 4,990,273 describes an antiwear additive for lubricating compositions which is the reaction product of 2,5-dimercapto-1,3,4-thiadiazole with an aldehyde and an amine.

U.S. Pat. No. 4,612,129 describes dimercapto-thiadiazole derivatives as corrosion inhibitors used in compositions containing a metal salt of a dithiocarbamic acid and an oil soluble sulfurized organic compound.

U.S. Pat. No. 4,301,019 describes reacting mercapto-thiadiazole with hydroxyl-containing unsaturated esters, or their borated derivatives to yield products useful as friction reducing additives in lubricants.

U.S. Pat. No. 4,140,643 describes reacting an oil-soluble dispersant with a dimercapto-thiadiazole and subsequently reacting the intermediate thus formed with a carboxylic acid or anhydride.

U.S. Pat. No. 4,136,043 describes reacting an oil soluble dispersant and a dimercapto-thiadiazole at 100–250° C. until the reaction product will form a homogeneous blend with a lubricating oil.

European Patent Application publication number 0630 960 A1 discloses the use of dimercapto-thiadiazoles with a copolymer of methacrylate, methyl-methacrylate and an amine-based antioxidant.

European Patent Application publication number 0601266 A1 describes compounds prepared by reacting 2,5-dimercapto-1,3,4-thiadiazole, aldehydes, and aromatic amines and their use as antiwear and antioxidant agents in lubricating compositions.

All patents and patent applications cited herein are incorporated herein by reference in their entirety.

SUMMARY OF THE INVENTION

It has been discovered in the present invention that levels of antifoam agent significantly higher than conventional levels can be utilized in ATFs without degradation of air release performance or impeding the release of entrained bubbles from the fluid, and with the unexpected beneficial effect of reducing, eliminating, and/or preventing automatic transmission pump whine. As used herein, transmission pump "whine" may include "launch whine", "continuous whine" and/or "gravel", as further described below.

In an embodiment of the present invention is presented a solution to the problem of degradation of the traditional antifoam agent used in ATFs and the problem of pump whine. Testing has shown that the traditional, polydimethyl siloxane, also known as silicone or PDMS, antifoam agents can lose their effectiveness due to thermal and mechanical degradation under the operating environment of compact transmissions. The loss of antifoam functionality as a result of and coupled with a high pressure pump sometimes results in unacceptably noisy pump whine. Thus, a CVT-equipped vehicle was subjected to standard on-and off-road driving for several thousand miles over routs commonly used by automakers to test the durability of a transmission.

"Top treating" such noisy vehicles, using specific antifoam agents and modified delivery techniques, has been successful in the present invention in converting the noise performance back to start-of-test levels with a dramatic reduction in the recurrence of pump whine.

Thus, the present invention relates to a method for reducing, eliminating or preventing pump whine in transmissions which exhibit (or which may potentially exhibit) pump whine, by lubricating the transmission with a fluid containing an Additive System or Antifoam Top Treat of the present invention, whereby the pump whine is reduced or eliminated relative to pump whine exhibited in transmissions not lubricated with a fluid containing an Additive System or Antifoam Top Treat of the present invention.

More specifically, the present invention provides an automatic transmission fluid, comprising an antifoam-effective amount of a silicon-containing antifoamant, such that the total amount of silicon in the automatic transmission fluid is at least 30 ppm.

In another embodiment is provided a method of reducing pump whine in an automatic transmission, comprising lubricating the transmission with a fluid comprising an oil having kinematic viscosity of 2–10 cSt at 100° C.; and an effective amount of a silicon-containing antifoam agent, such that the total amount of silicon in the automatic transmission fluid is at least 30 ppm, wherein the amount of pump whine is reduced relative to the pump whine produced in a transmission not lubricated with a fluid containing at least 30 ppm silicon.

Antifoam agents function in part by having a preferential tendency to reside on the surface of bubbles. However, in hydraulic pumps, the act of adiabatically compressing any entrained air causes the surface of air bubbles to reach high temperatures. These temperatures can be extreme, in some cases greater than 500° C., in some high-pressure pumps. At these elevated temperatures, the antifoam is subject to thermal degradation. The traditional PDMS antifoam molecule has been shown to be thermally stable only up to about 200° C. These traditional molecules are therefore subject to thermal breakdown in the modern transmission environment.

Antifoam needs to be dispersed, but not necessarily dissolved, in the form of liquid droplets above a minimum size in order to be functional in an ATF. Thermal degradation of the molecules of the antifoam agent inhibits the ability of the antifoam agent molecules to form droplets of effective size. Thermal degradation of the antifoam agent results in antifoam agent molecules that are undesirably further solubilized (i.e., dissolved) in the ATF, such that they are no longer functional, or are even counter-productive.

In one embodiment of the present invention is the use of a more thermally stable antifoam molecule in high-pressure ATF applications. This molecule is thermally stable to about 600° C. and is more resistant to thermal degradation from adiabatic compression of air.

Another feature of the present invention is the ability to introduce an even more insoluble antifoam agent at markedly higher concentrations. By the present invention, an ATF is severely over-treated with a silicone antifoam agent above targeted conventional levels of antifoam concentration. The over-treat provides the driving force for dispersion of a sufficient quantity of an insoluble material into the ATF. The high shear environment of the high-pressure pump serves as an additional tool for dispersing the antifoam agent. The combined effect is a forced dispersion, or forcibly dispersed, antifoam at concentrations well above conventional industry levels. Silicone antifoam agents or defoamants herein can include but are not limited to polydimethylsiloxane (PDMS) fluids and polymers.

Conventional wisdom says adding more antifoam will result in an unstable mixture in which the antifoam will settle, precipitate or fall out during shipping and storage before being added to the transmission. For this reason, oil companies do not blend ATFs with elevated silicon contents above typical values because their products would lack long-term stability. Additionally, antifoam requires a high degree of shear to blend into a stable dispersion. Adding a high level of silicone antifoam agent directly to a transmission has previously not been thought possible due to the special blending process required to reduce the antifoam to dispersed droplet size that is within a functional range. However, according to an embodiment of the present invention, such an unexpected high treat rate of silicone antifoam in transmissions with a high shear fluid pump is demonstrated as effective in control of air entrainment and its associated pump whine. This treat rate can be at least 30 ppm silicon in the automatic transmission fluid, and in a preferred embodiment, at least 50 to 70 ppm silicon in the fluid.

Yet another feature of the present invention is in the method of delivering the antifoam to the transmission. In one embodiment, the antifoam is directly injected into the transmission (i.e., the transmission is "top treated"). This direct addition is useful for avoiding additive fall-out or settling of the agent in the ATF or the additive system prior to introduction to the transmission. The high shear rate associated with large pressure drops from the high-pressure pump has proven adequate to blend the antifoam into ATF to required droplet sizes for functionality.

The combined thermally stable molecule, high concentrations, and direct injection into the transmission are effective in maintaining acceptable air (thus noise) levels.

This invention comprises a lubricating/functional fluid composition (e.g., a fully-formulated ATF) with improved antiwear, antifoaming, noise-reducing, and low temperature viscosity properties. In an embodiment, the composition of the present invention contains:

A. An oil of lubricating viscosity having a 100° C. kinematic viscosity of 2–10 cSt;

B. sufficient weight percent of 2,5-dimercapto-1,3,4-thiadiazole (DMTD) and/or derivatives thereof to provide the composition with acceptable antiwear properties;

C. an additive system containing an antifoam agent;

D. an acrylate, methacrylate, polyacrylate, or polymethacrylate or copolymer thickener; and E. an optional air release agent.

The Additive System composition may also contain boron as contributed by borated dispersants or other borated materials such as borated epoxides or mixtures thereof. The Additive System composition may further contain phosphorus which may be contributed by phosphorus acid esters, such as dibutyl hydrogen phosphite, diphenyl hydrogen phosphite, triphenyl phosphite, and/or triphenyl thiophosphate.

Thus, a feature of the present invention is to provide an additive system for an automatic transmission fluid, comprising an oil having kinematic viscosity of 2–10 cSt at 100° C.; and an effective amount of a silicon-containing antifoam agent, such that the total amount of silicon added to the automatic transmission fluid is at least 30 ppm.

Another feature of the present invention is to provide a method of treating an automatic transmission, comprising directly injecting into said transmission a composition comprising at least one silicone antifoam agent, with or without carrier oil.

It is to be understood that both the foregoing general description and the following detailed description are exemplary and explanatory only and are intended to provide further explanation of the present invention, as claimed.

DESCRIPTION OF THE PREFERRED EMBODIMENT

The present invention utilizes an Antifoam Top Treat having unconventionally high levels of antifoam agent, which is directly injected as a top treat into (or is otherwise mixed with) the ATF in the transmission to reduce or prevent pump whine. In an embodiment of the present invention, the ATF also contains an optional air release agent. The present invention also includes an Additive System containing the aforementioned unconventionally high levels of antifoam agent, which may be mixed with other compositions by ATF formulators for providing an ATF which likewise has unconventionally high levels of antifoam agent.

Antifoam Top Treat

As mentioned above, an Antifoam Top Treat according to the present invention may be directly injected (e.g., via syringe) or otherwise added into an automatic transmission. Because of the high shear rate of many automatic transmission pumps (e.g., especially CVT pumps), the Antifoam Top Treat is quickly and effectively mixed into the ATF. We have discovered that if the antifoam agent is mixed into the ATF at unconventionally high levels, then the resulting mixture has unexpected efficacy for reducing, eliminating, and preventing pump whine.

The treat rate for the antifoam (i.e., the amount of Antifoam Top Treat needed to effectively reduce pump whine) is that necessary to deliver at least 30 ppm of silicon, and more preferably from 50 to about 70 ppm of silicon, to the finished lubricating transmission oil/ATF, provided it were to be uniformly dispersed in the fluid. A preferred antifoam agent contains ~19% elemental Si, so the treat rate of the antifoam can be 250 to 500 ppm and preferably about 320 to 360 ppm in the finished oil. A diluent or carrier can be added with the antifoam at from about 750 to about 1500 ppm, and more preferably about 1031 ppm. The preferred diluent is a Group IV polyalphaolefin oil. In one embodiment, the Antifoam Top Treat may deliver 320 ppm of Dow Corning FS-1265 (1000 centistokes) antifoam agent, along with 950 ppm of 100 cSt PAO as a diluent/carrier.

One method of treating an automatic transmission having ATF therein according to the present invention includes the step of adding into the transmission a composition comprising an antifoam agent, with or without a diluent/carrier oil, wherein the antifoam agent is provided at an unconventionally high level of 260 to 370 ppm relative to the amount of ATF. This step of adding the antifoam agent composition may be performed by direct injection thereof into the transmission, such as by syringe, a metering apparatus, or otherwise. Also, this step may be performed: at the initial building of the transmission; at its initial installation into a vehicle; at prescribed service intervals; when pump whine is or has been noticed; at any servicing, maintenance or rebuilding of the transmission; at any topping off, filling or refilling of the transmission with fluid; and/or the like.

For example, one method according to the present invention comprises the steps of: (a) building a new automatic transmission, (b) filling the transmission with ATF, (c) performing functional tests on the transmission, (d) removing some portion (e.g., one-half) of the ATF from the transmission, (e) adding Antifoam Top Treat into the partially-filled transmission, (f) shipping the transmission (e.g., to a dealer, service site, vehicle etc.), and (g) filling up the transmission with ATF. This process may optionally include the step of installing the transmission into a vehicle after step (a).

Alternatively, rather than adding the unconventionally high level of antifoam agent into the transmission (i.e., top treating the transmission), a method according to the present invention also includes the step of mixing this high level of antifoam agent with an ATF prior to filling or topping off an automatic transmission with initial or additional ATF. This prior mixing of the antifoam agent and ATF may be done by mixing the agent alone (with or without a diluent/carrier) directly with the ATF, or by mixing the aforementioned Additive System with the ATF. Either way, a Fully-Formulated ATF is thus prepared which has the desired high levels of antifoam agent therein. This antifoam agent-rich ATF may then be used to fill, refill, or top off an automatic transmission, so as to reduce previously noticed pump whine or to guard against potential pump whine.

It should be noted that the step of adding Antifoam Top Treat, an Additive System, or a Fully-Formulated ATF to a transmission according to the present invention may include adding such into the transmission case, the sump, the pump itself, a fill tube, a dipstick tube, a service port, the torque converter, the valve body, an accumulator, the hydraulic lines, or elsewhere in direct or indirect fluid communication with the pump. The location where the Top Treat, Additive System or Fully-Formulated ATF is added may be proximate the transmission, or it may be at some relatively distal point from the transmission, such as at a suitable port in the pump/transmission hydraulic lines adjacent the radiator/condenser/oil cooler.

Testing has shown that adding an unconventionally high level of antifoam agent into a transmission can be very effective at reducing, eliminating, and/or preventing transmission pump whine, relative to the pump whine produced in transmissions not lubricated with a fluid having greater than 30 ppm silicon. For example, TABLE 1 shows the "whine" and "gravel" noise levels of transmission pumps on seven different CVT transmissions (labelled A through J) both immediately before and immediately after top treating the transmissions with 3 to 6 cc of low molecular weight Antifoam Top Treat additive. (Each transmission nominally contained about 7000 to 9000 cc of ATF prior to being top treated.) These noise levels were determined using General Motors Uniform Test Standard (GMUTS) R-15-104x2, which is a subjective, qualitative test which uses a 1-to-10 rating scale. On this scale, ratings of 2, 4, 6, 8, and 10 represent noise levels that are "Bad", "Poor", "Fair", "Good", and "Excellent", respectively. When a transmission pump is tested for noise level using this GMUTS, typically the one or more trained technicians/engineers who are listening to the transmission will present their individual ratings of the noise, and the ultimate rating ascribed to the transmission pump's noise level will be an average or consensus of the various individual ratings. Typically, a change of ±1 on the GMUTS scale is equivalent to about ±3 dBA in sound pressure level, or about ±50% in measured sound pressure level. The "whine" rating shown in TABLE 1 refers to "launch whine", which is the pump whine sound that may occur when the driver steps on the gas/accelerator pedal, as distinguished from "continuous whine" which is the whine sound that the transmission pump may produce continuously. The "gravel" rating refers to the "gravelly" sound sometimes produced by a transmission pump when there is a sudden acceleration, deceleration, or change in the pitch, roll, or yaw of the vehicle, such as when the brakes are slammed on by the driver, the vehicle suddenly ascends or descends a hill, the vehicle suddenly accelerates, etc. When such events occur, the ATF fluid sloshes around in the sump so as to sometimes temporarily expose the pump inlet (which is typically located toward the bottom or lowest level of the sump) to the relatively larger bubbles that are sometimes present on the top surface of the fluid, thus permitting the pump to temporarily gulp in these larger bubbles. Because these bubbles are typically larger than those entrained within the fluid (and which contribute to whine), the "gravel" noise they cause is typically of a lower frequency than "whine" noise. As shown by TABLE 1, the Antifoam Top Treat significantly improved both "whine" and "gravel" in practically every case. (Note that Transmission B had two top treats, spaced apart from one another by several thousand miles of duty cycle.)

TABLE 1

| Transmission | | Before Top Treat | After Top Treat | Change |
|---|---|---|---|---|
| A | (whine) | 3–4 | 9 | +5–6 |
| | (gravel) | 4 | 6–7 | +2–3 |
| B | (whine) | 5 | 9 | +4 |
| | (gravel) | 5 | 5 | +0 |
| | (whine) | 6–7 | 9 | +2–3 |
| | (gravel) | 4 | 7–8 | +3–4 |
| C | (whine) | 6 | 9 | +3 |
| | (gravel) | 4 | 8 | +4 |
| D | (whine) | 3 | 9 | +6 |
| | (gravel) | 4 | 6–7 | +2–3 |
| E | (whine) | 6 | 9 | +3 |
| | (gravel) | 4 | 8 | +4 |
| F | (whine) | 3 | 9 | +6 |
| | (gravel) | 4 | 6–7 | +2–3 |
| G | (whine) | 6 | 9 | +3 |
| | (gravel) | 6 | 7.5 | +1.5 |
| H | (whine) | 4–6 | 9 | +3–5 |
| | (gravel) | 7 | 9 | +2 |
| I | (whine) | 5 | 7–8 | +2–3 |
| | (gravel) | 6 | 8 | +2 |
| J | (whine) | 6 | 9 | +3 |
| | (gravel) | 5–6 | 6–7 | +0–2 |

It may be noted that although the "whine" ratings in TABLE 1 are for "launch whine", it was discovered during testing that in every instance continuous whine was also favorably reduced by top treating the transmission pump with Antifoam Top Treat.

In addition to reducing or eliminating whine/gravel, applying the Antifoam Top Treat (whether at the initial build of the transmission or at any time later) also has the beneficial effect of preventing and/or delaying the onset of objectionable levels of whine/gravel, as illustrated in TABLE 2 below. This table compares the GMUTS "whine" and "gravel" ratings of various "Untreated" transmissions (i.e., having no Antifoam Top Treat) to several "Top Treated" transmissions (i.e., having been treated with Antifoam Top Treat at the beginning of the transmission's duty cycle), at various selected mileages throughout their respective tests. For example, note that the "Untreated" transmissions exhibited "whine" and "gravel" ratings below 6 as early as 4,743 miles, whereas the "Top Treated" transmissions maintained their ratings at or above 6 for as long as 15,180 miles.

TABLE 2

| Mileage on | Untreated | | Top Treated | |
|---|---|---|---|---|
| Transmission | Whine | Gravel | Whine | Gravel |
| 4,390 | — | — | 7.5–8.5 | 7 |
| 4,743 | 5 | 5 | — | — |
| 7,154 | — | — | 8 | 6.5–7 |
| 8,387 | 6 | 4 | — | — |
| 8,690 | 5 | 6 | — | — |
| 9,139 | 3–4 | 4 | — | — |
| 10,468 | — | — | 7.5–8 | 6.5–8 |
| 12,375 | — | — | 6–6.5 | 6.5 |
| 13,632 | — | — | 7 | 7 |
| 15,180 | — | — | 6 | 6 |
| 20,167 | — | — | 5.5 | 5.5–6 |

Additive System

In an embodiment, the additive system of the present invention contains N-aliphatic alkyl-substituted diethanolamine, phosphorylated and boronated ashless dispersant, a sulfurized fatty oil friction modifier, a copper corrosion inhibitor, a silicone antifoam agent (also referred to as "antifoamant"), nonylated diphenyl amine, a calcium hydroxide salt of sulfurized alkyl phenate (TBN 150), octanoic acid, 3-decyloxypropylamine, an ethylene oxide-propylene oxide (EO-PO) block copolymer, an alkyl polyoxyalkylene ether, an acrylate polymer surfactant, and a diluent oil.

Another important ingredient of the additive system or transmission fluid of this invention is an antifoaming agent. Antifoaming agents are well-known in the art as silicone or fluorosilicone compositions, as well as certain acrylate, polyacrylate, and polymethacrylate (PMA) polymers. Such silicone antifoam agents are available from Dow Corning Corporation and Union Carbide Corporation. A preferred fluorosilicone antifoam product is Dow Corning FS-1265 (1000 centistokes). Preferred silicone antifoam products are Dow Corning DC-200 and Union Carbide UC-L45. The silicone antifoamant useful in this invention can be PDMS, phenyl-methyl polysiloxane, linear, cyclic or branched siloxanes, silicone polymers and copolymers, and organosilicone copolymers. Another antifoam agent which may be included in the composition in admixture is a polyacrylate antifoamant such as that available from Monsanto Polymer Products Co. of Nitro, W. Va. known as PC-1244. Also, a siloxane polyether copolymer antifoamant available from OSI Specialties, Inc. of Farmington Hills, Mich. and may be substituted or included. One such material is sold as SIL-WET-L-7220. The silicon-containing antifoam products are included in the compositions of this invention at a level of 350 to 1000 parts per million with the active ingredient being on an oil-free basis. Such a high level of antifoamant is novel and is surprisingly stable and effective in the compositions of the present invention.

When both flourosilicone antifoamants and acrylate, polyacrylate or PMA antifoamants (collectively referred to herein as "acrylate antifoamant") are used in the compositions of the present invention, a preferred ratio of antifoamants can exist. Thus, a preferred weight ratio of the fluorosilicone antifoamant to the acrylate antifoamant is from about 3:1 to about 1:4. A more preferred weight ratio is from about 2:1 to about 1:3.

The following additive system example further illustrates aspects of the present invention but does not limit the present invention.

EXAMPLE

| Components | % |
|---|---|
| N-aliphatic alkyl-substituted diethanolamine | 0.08 to 0.30 weight percent; |
| Phosphorylated and boronated ashless dispersant | 2.5 to 5.0 weight percent; |
| Sulfurized fatty oil friction modifier | 0.60 to 1.20 weight percent; |
| Copper corrosion inhibitor | 0.02 to 0.10 weight percent; |
| Silicone antifoamant | 0.02 to 0.10 weight percent; |
| Nonylated diphenyl amine | 0.15 to 0.45 weight percent; |
| $Ca(OH)_2$ salt of sulfurized alkyl phenate (TBN 150) | 0.02 to 0.10 weight percent; |
| Octanoic acid | 0.02 to 0.10 weight percent; |
| 3-decyloxypropylamine | 0.02 to 0.10 weight percent; |
| Ethylene oxide-propylene oxide block copolymer | 0.005 to 0.10 weight percent; |
| Alkyl polyoxyalkylene ether | 0.02 to 0.10 weight percent; |
| Acrylate polymer | 0.015 to 0.060 weight percent; |
| Diluent oil | greater than 0.10 weight percent. |

Fully-Formulated ATF

A fully-formulated composition for use as contemplated by this invention may contain, in addition to the components listed above:

1. borated and/or non-borated dispersants;
2. anti-oxidation compounds;
3. seal swell compositions (also called agents);
4. friction modifiers;
5. extreme pressure/anti-wear agents;
6. viscosity modifiers;
7. pour point depressants;
8. detergents.

Examples of these components are well known to those skilled in the art.

Air Release Agent/Air Entrainment Control Additive

One or more of several known air entrainment control additives is or are useful, but not required, in the present invention. When used, air entrainment control additives are those materials, chemicals or additives which by chemical and/or physical means cause or enable trapped or entrained air or other gases to more readily be released from the fluid or mixture.

Preferred air entrainment control additives when used herein can include, for example, fluorinated components, silicone based components, acrylate, polyacrylate or PMA based components, and the more preferred class of air entrainment control additives useful in the present invention is fluorinated components. The air release agent can be added to or with the Antifoam Top Treat, the Additive System or to the ATF.

VI Improver

A viscosity index improver is useful in the formulations and methods of the present invention and can include, but is/are not limited to, one or more materials selected from polyacrylate, polymethacrylate, styrene/olefin copolymer, styrene diene copolymer, EP copolymer or terpolymers, and combinations thereof. A preferred VI Improver is a highly shear stable polymethacrylate polymer or copolymer used at, for example, 15 wt % in the fluid formulation. A preferred VI Improver is HiTEC® 5769 VI Improver available from Ethyl Corporation.

Detergent/Dispersant

Preferably the compositions of this invention contain a N-aliphatic alkyl-substituted diethanolamine, herein referred to as component (i), and at least one oil-soluble phosphorus-containing ashless dispersant present in amount such that the ratio of phosphorus in said ashless dispersant to component (i) is in the range of about 0.1 to about 0.4 part by weight of phosphorus per part by weight of component (i); and/or at least one oil-soluble boron-containing ashless dispersant present in amount such that the ratio of boron in said ashless dispersant to said component (i) is in the range of about 0.05 to about 0.2 part by weight of boron per part by weight of component (i). Most preferably, the compositions of this invention contain at least one oil-soluble phosphorus- and boron-containing ashless dispersant present in amount such that the ratio of phosphorus in said ashless dispersant to said component (i) is in the range of about 0.15 to about 0.3 part by weight of phosphorus per part by weight of component (i), and such that the ratio of boron in said ashless dispersant to said component (i) is in the range of about 0.05 to about 0.15 part by weight of boron per part by weight of component (i).

The foregoing phosphorus- and/or boron-containing ashless dispersants can be formed by phosphorylating and/or boronating an ashless dispersant having basic nitrogen and/or at least one hydroxyl group in the molecule, such as a succinimide dispersant, succinic ester dispersant, succinic ester-amide dispersant, Mannich base dispersant, hydrocarbyl polyamine dispersant, or polymeric polyamine dispersant.

The polyamine succinimides in which the succinic group contains a hydrocarbyl substituent containing at least 30 carbon atoms are described for example in U.S. Pat. Nos. 3,172,892; 3,202,678; 3,216,936; 3,219,666; 3,254,025; 3,272,746; and 4,234,435. The alkenyl succinimides may be formed by conventional methods such as by heating an alkenyl succinic anhydride, acid, acid-ester, acid halide, or lower alkyl ester with a polyamine containing at least one primary amino group. The alkenyl succinic anhydride may be made readily by heating a mixture of olefin and maleic anhydride to about 180° C.–220° C. The olefin is preferably a polymer or copolymer of a lower monoolefin such as ethylene, propylene, 1-butene, isobutene and the like. The more preferred source of alkenyl group is from polyisobutene having a GPC number average molecular weight of up to 10,000 or higher, preferably in the range of about 500 to about 2,500, and most preferably in the range of about 800 to about 1,200.

As used herein, the term "succinimide" is meant to encompass the completed reaction product from reaction between one or more polyamine reactants and a hydrocarbon-substituted succinic acid or anhydride (or like succinic acylating agent), and is intended to encompass compounds wherein the product may have amide, amidine, and/or salt linkages in addition to the imide linkage of the type that results from the reaction of a primary amino group and an anhydride moiety.

Alkenyl succinic acid esters and diesters of polyhydric alcohols containing 2–20 carbon atoms and 2–6 hydroxyl groups can be used in forming the phosphorus- and/or boron-containing ashless dispersants. Representative examples are described in U.S. Pat. Nos. 3,331,776; 3,381,022; and 3,522,179. The alkenyl succinic portion of these esters corresponds to the alkenyl succinic portion of the succinimides described above.

Suitable alkenyl succinic ester-amides for forming the phosphorylated and/or boronated ashless dispersant are described for example in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540.

Hydrocarbyl polyamine dispersants that can be phosphorylated and/or boronated are generally produced by reacting an aliphatic or alicyclic halide (or mixture thereof) containing an average of at least about 40 carbon atoms with one or more amines, preferably polyalkylene polyamines. Examples of such hydrocarbyl polyamine dispersants are described in U.S. Pat. Nos. 3,275,554; 3,394,576; 3,438,757; 3,454,555; 3,565,804; 3,671,511; and 3,821,302.

In general, the hydrocarbyl-substituted polyamines are high molecular weight hydrocarbyl-N-substituted polyamines containing basic nitrogen in the molecule. The hydrocarbyl group typically has a number average molecular weight in the range of about 750–10,000, more usually in the range of about 1,000–5,000, and is derived from a suitable polyolefin. Preferred hydrocarbyl-substituted amines or polyamines are prepared from polyisobutenyl chlorides and polyamines having from 2 to about 12 amine nitrogen atoms and from 2 to about 40 carbon atoms.

Mannich polyamine dispersants which can be utilized in forming the phosphorylated and/or boronated ashless dispersant is a reaction product of an alkyl phenol, typically having a long chain alkyl substituent on the ring, with one or more aliphatic aldehydes containing from one to about seven carbon atoms (especially formaldehyde and derivatives thereof), and polyamines (especially polyalkylene polyamines). Examples of Mannich condensation products, and methods for their production are described in U.S. Pat. Nos. 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

The preferred hydrocarbon sources for preparation of the Mannich polyamine dispersants are those derived from substantially saturated petroleum fractions and olefin polymers, preferably polymers of mono-olefins having from 2 to about 6 carbon atoms. The hydrocarbon source generally contains at least about 40 and preferably at least about 50 carbon atoms to provide substantial oil solubility to the dispersant. The olefin polymers having a GPC number average molecular weight between about 600 and 5,000 are preferred for reasons of easy reactivity and low cost. However, polymers of higher molecular weight can also be used. Especially suitable hydrocarbon sources are isobutylene polymers.

The preferred Mannich base dispersants for this use are Mannich base ashless dispersants formed by condensing about one molar proportion of long chain hydrocarbon-substituted phenol with from about 1 to 2.5 moles of formaldehyde and from about 0.5 to 2 moles of polyalkylene polyamine.

Polymeric polyamine dispersants suitable for preparing phosphorylated and/or boronated ashless dispersants are polymers containing basic amine groups and oil solubilizing groups (for example, pendant alkyl groups having at least about 8 carbon atoms). Such materials are illustrated by interpolymers formed from various monomers such as decyl methacrylate, vinyl decyl ether or relatively high molecular weight olefins, with aminoalkyl acrylates and aminoalkyl acrylamides. Examples of polymeric polyamine dispersants are set forth in U.S. Pat. Nos. 3,329,658; 3,449,250; 3,493,520; 3,519,565; 3,666,730; 3,687,849; and 3,702,300.

Base Oils

The base oils used in forming the automatic transmission fluids of this invention can be any suitable natural or synthetic oil having the necessary viscosity properties for this usage. Thus, the base oil may be composed entirely of a natural oil such as mineral oil of suitable viscosity or it may be composed entirely of a synthetic oil such as a poly-alpha-olefin oligomer of suitable viscosity. Likewise, the base oil may be a blend of natural and synthetic base oils provided that the blend has the requisite properties for use in the formation of an automatic transmission fluid. Ordinarily, the base oil should have a kinematic viscosity in the range of 3 to 8 centistokes (cSt) at 100° C. Preferred base oils are Group III stocks. A preferred base oil viscosity is, for example, 3.8 cSt for the ratio of VHVI 2 and VHVI 4 that is used. In an embodiment of the present invention, the individual viscosities of those base stocks are 2.8 cSt and 4.3 cSt, respectively. Such base stocks useful in the present invention can include without limitation those manufactured by PetroCanada.

Included in the oil of lubricating viscosity in the present invention is 0.025–5 weight percent on an oil-free basis based on the weight of the lubricating composition of 2,5-dimercapto-1,3,4-thiadiazole (DMTD) or derivatives thereof. Derivatives of DMTD are:

a) 2-hydrocarbyldithio-5-mercapto-1,3,4-thiadiazole or 2,5-bis-(hydrocarbyldithio)-1,3,4-thiadiazole and mixtures thereof;
b) carboxylic esters of DMTD;
c) condensation products of halogenated aliphatic monocarboxylic acids with DMTD;
d) reaction products of unsaturated cyclic hydrocarbons and unsaturated ketones with DMTD;
e) reaction products of an aldehyde and diaryl amine with DMTD;
f) amine salts of DMTD;
g) dithiocarbamate derivatives of DMTD;
h) reaction products of an aldehyde, and an alcohol or aromatic hydroxy compound, and DMTD;
i) reaction products of an aldehyde, a mercaptan and DMTD;
j) 2-hydrocarbylthio-5-mercapto-1,3,4-thiadiazole;
k) products from combining an oil soluble dispersant with DMTD; and mixtures thereof.

Components a)–k) are described in U.S. Pat. No. 4,612,129 and patent references cited therein. These referenced are included herein by reference. The preferred thiadiazoles for use in this invention are those listed in a), h) and k) above. 2,5-bis-(hydrocarbyldithio)-1,3,4-thiadiazole and its mono-substituted equivalent 2-hydrocarbylthio-5-mercapto-1,3,4-thiadiazole are commercially available as a mixture of the two compounds in a ratio of about 85 percent bis-hydrocarbyl to 15 percent monohydrocarbyl from the Ethyl Corporation as HiTEC® 4313.

Dye

A dye can be added to the compositions of the present invention. If a dye is added, the preferred level is from about 0.005 wgt percent to about 0.05 wgt percent of the ATF.

Seal Swell Agent

Depending on the base stocks that are chosen, an amount of seal swell agent could be required to meet the OEM seal compatibility requirements. Use of Group II, Group III and Group IV base oils many times require the addition of a material to swell seals. These materials are chosen from the general categories of oil soluble diesters, aromatic base oils, and sulfones. Alkyl adipates are examples of soluble diesters that can be used. Most preferred in this invention is alkyl adipate used at a treat rate of 3 to 20%, more preferably 3 to 10%, and most preferably 5%.

The compositions of the present invention are therefore useful in the lubrication and treatment of power transmissions. Transmissions treated with the compositions or methods of the present invention are also included in this invention, as well as vehicles having transmissions treated with the compositions or methods of the present invention.

In other embodiments, the present invention is directed to methods of lubricating transmissions, methods of reducing foaming of transmissions fluids, methods of decreasing aeration in a transmission fluid by aiding the release of entrained bubbles in said fluid, methods of treating an automatic transmission by directly injecting into the transmission an antifoam composition, and methods of reducing or eliminating pump whine in an automatic transmission by adding a composition of the present invention.

Thus, the present invention is also directed to an automatic transmission containing the ATF lubricating composition of the present invention, a transmission lubricated by the methods of the present invention, and further directed to a vehicle containing such an automatic transmission.

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims. This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part of the invention under the doctrine of equivalents.

The invention claimed is:

1. An automatic transmission fluid, comprising an antifoam-effective amount of a silicon-containing antifoamant, such that the total amount of silicon in the automatic transmission fluid provided by the antifoamant is at least 30 ppm.

2. The fluid of claim 1, wherein said fluid has less than 0.01 weight percent of 85% phosphoric acid.

3. The fluid of claim 1, wherein the silicon-containing antifoamant comprises a mixture of polydimethylsiloxane and fluorosilicone antifoamant.

4. The fluid of claim 1, further comprising an acrylate polymer antifoamant.

5. The fluid of claim 4, wherein the acrylate polymer antifoamant is selected from the group consisting of a polymethacrylate, a polyacrylate, a dispersant polymethacrylate, a dispersant polyacrylate, and a mixture thereof.

6. The fluid of claim 1, wherein the silicon-containing antifoamant is a mixture of polydimethylsiloxane and fluorosilicone antifoamant, and further comprising an acrylate polymer antifoamant, wherein the weight ratio of the fluorosilicone antifoamant to the acrylate antifoamant is from about 3:1 to about 1:4.

7. An automotive transmission fluid comprising:

| | |
|---|---|
| N-aliphatic alkyl-substituted diethanolamine | 0.08 to 0.30 weight percent; |
| Phosphorylated and boronated ashless dispersant | 2.5 to 5.0 weight percent; |
| Sulfurized fatty oil friction modifier | 0.60 to 1.20 weight percent; |
| Copper corrosion inhibitor | 0.02 to 0.10 weight percent; |
| Silicone antifoamant | 0.02 to 0.10 weight percent; |
| Nonylated diphenyl amine | 0.15 to 0.45 weight percent; |
| $Ca(OH)_2$ salt of sulfurized alkyl phenate (TBN 150) | 0.02 to 0.10 weight percent; |
| Octanoic acid | 0.02 to 0.10 weight percent; |
| 3-decyloxypropylamine | 0.02 to 0.10 weight percent; |
| Ethylene oxide-propylene oxide block copolymer | 0.005 to 0.10 weight percent; |
| Alkyl polyoxyalkylene ether | 0.02 to 0.10 weight percent; |
| Acrylate polymer | 0.015 to 0.060 weight percent; |
| Diluent oil | greater than 0.10 weight percent; |

wherein the silicone antifoamant imparts greater than 30 ppm silicon to the fluid.

8. An automatic transmission fluid, comprising:

a) an oil of lubricating viscosity having a 100° C. kinematic viscosity of 2–10 cSt;

b) sufficient weight percent of 2,5-dimercapto-1,3,4-thiadiazole (DMTD) and/or derivatives or precursors thereof to provide the fluid with antiwear properties;

c) a silicon-containing antifoam agent which imparts greater than 30 ppm silicon to the fluid; and d) an acrylate, methacrylate, polyacrylate, polymethacrylate, or copolymer or terpolymer thereof.

9. The fluid of claim 8, wherein the silicon-containing antifoam agent comprises a mixture of polydimethylsiloxane and fluorosilicone antifoamant.

10. An automatic transmission lubricated with a lubricating oil comprising the fluid of claim 1.

11. An automatic transmission lubricated with a lubricating oil comprising the automatic transmission fluid of claim 7.

12. The automatic transmission of claim 10, wherein the transmission is a continuously variable transmission.

13. A method of treating an automatic transmission having space between moving parts, comprising directly injecting into said space in said transmission a fluid composition comprising at least one silicone antifoam agent wherein the silicone antifoam agent imparts greater than 30 ppm silicon to the fluid.

14. The method of claim 13, wherein the composition further comprises a carrier oil.

15. A method of reducing pump whine in an automatic transmission, comprising lubricating the transmission with a fluid comprising an oil having kinematic viscosity of 2–10 cSt at 100° C.; and an effective amount of a silicon-containing antifoam agent, such that the total amount of silicon in the automatic transmission fluid provided by the antifoam agent is at least 30 ppm, wherein the amount of pump whine is reduced relative to the pump whine produced in a transmission not lubricated with a fluid containing at least 30 ppm silicon provided by an antifoam agent.

16. The method of claim 15, wherein the total amount of silicon in the automatic transmission fluid provided by the antifoam agent is greater than 50 ppm.

17. The method of claim 15, wherein the total amount of silicon in the automatic transmission fluid provided by the antifoam agent is 50 to 70 ppm.

18. A method to decrease aeration in an automotive transmission fluid in an automotive transmission by aiding the release of entrained bubbles in said fluid, said method comprising lubricating the transmission with a transmission fluid comprising a mixture of polydimethylsiloxane and fluorosilicone antifoam agents, wherein the total amount of silicon in the automatic transmission fluid provided by the antifoam agents is greater than 30 ppm.

19. A method for reducing foaming of a hydrocarbon oil used as a transmission lubricating and power transmitting fluid in a vehicle, said method comprising injecting directly into said oil in a transmission a composition comprising an insoluble antifoam agent and an inert carrier oil, wherein the antifoam agent imparts greater than 30 ppm silicon to the fluid.

20. The method of claim 19, wherein the antifoam agent is a silicon-containing material selected from the group consisting of fluorosilicones, polydimethylsiloxane, phenyl-methyl polysiloxane, linear siloxanes, cyclic siloxanes, branched siloxanes, silicone polymers and copolymers, and organo-silicone copolymers, and wherein the silicone provided by the antifoam agent is present in the fluid at an amount greater than 30 ppm.

21. The method of claim 20, wherein the injecting occurs into the transmission case, a sump, a fluid pump, a fill tube, a dipstick, a service port, a torque converter, a valve body, an accumulator, or a hydraulic line.

22. A vehicle comprising a transmission lubricated with a lubricant comprising the fluid of claim 1.

23. A vehicle lubricated by the method of claim 13.

24. A vehicle lubricated by the method of claim 15.

25. A vehicle lubricated by the method of claim 18.

26. A vehicle lubricated by the method of claim 19.

* * * * *